US008879967B2

(12) United States Patent
Hasegawa

(10) Patent No.: US 8,879,967 B2
(45) Date of Patent: Nov. 4, 2014

(54) DEVELOPMENT DEVICE AND IMAGE FORMATION APPARATUS

(71) Applicant: Oki Data Corporation, Tokyo (JP)

(72) Inventor: Kentaro Hasegawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 81 days.

(21) Appl. No.: 13/763,752

(22) Filed: Feb. 11, 2013

(65) Prior Publication Data

US 2013/0209114 A1 Aug. 15, 2013

(30) Foreign Application Priority Data

Feb. 13, 2012 (JP) ..... 2012-028687

(51) Int. Cl.
*G03G 15/08* (2006.01)

(52) U.S. Cl.
CPC ..... *G03G 15/0832* (2013.01); *G03G 15/0831* (2013.01); *G03G 15/0808* (2013.01)
USPC ..... 399/281

(58) Field of Classification Search
CPC ..... G03G 15/0643; G03G 15/0808; G03G 2215/0643
USPC ..... 399/279, 281, 285
See application file for complete search history.

(56) References Cited

U.S. PATENT DOCUMENTS 5,495,322 A * 2/1996 Wada et al. ..... 399/285
7,116,933 B2 * 10/2006 Okada ..... 399/285
2012/0148314 A1 * 6/2012 Park et al. ..... 399/281

FOREIGN PATENT DOCUMENTS

JP 05-027567 A 2/1993

* cited by examiner

*Primary Examiner* — Gregory H Curran
(74) *Attorney, Agent, or Firm* — Marvin A. Motsenbocker; Mots Law, PLLC

(57) ABSTRACT

A development device includes a developer carrier configured to develop an electrostatic latent image by causing a developer to adhere to an electrostatic latent image carrier, a first supply member disposed in non-contact with the developer carrier and configured to supply a developer to the developer carrier, a second supply member disposed in contact with the first supply member below the first supply member and configured to supply the developer to the first supply member, and a developer holder configured to hold the developer for replenishing the second supply member. The first supply member and the second supply member rotate so that the surfaces thereof move in the same direction at their opposed parts.

18 Claims, 24 Drawing Sheets

DEVELOPMENT DEVICE AND IMAGE FORMATION APPARATUS

CROSS REFERENCE TO RELATED APPLICATIONS

This application claims priority based on 35 USC 119 from prior Japanese Patent Application No. 2012-028687 filed on Feb. 13, 2012, entitled "DEVELOPMENT DEVICE AND IMAGE FORMATION APPARATUS", the entire contents of which are incorporated herein by reference.

BACKGROUND OF THE INVENTION

1. Field of the Invention

The disclosure relates to a development device and an image formation apparatus using the development device.

2. Description of Related Art

Some development devices for an image formation apparatus convey a toner accumulated in the lower portion thereof to a development roller through an application roller and a supply roller (from lower to higher) (for example, see Patent Literature 1: Japanese Patent Application Publication No. Hei 5-27567 (FIG. 1)).

SUMMARY OF THE INVENTION

However, conventional development devices may have low image quality.

It is an object of an embodiment of the invention to improve the image quality.

An aspect of the invention is a development device that includes a developer carrier configured to develop an electrostatic latent image by causing a developer to adhere to an electrostatic latent image carrier, a first supply member disposed in a non-contact position ("non-contact") with the developer carrier and configured to supply a developer to the developer carrier, a second supply member disposed in contact with the first supply member below the first supply member and configured to supply the developer to the first supply member, and a developer holder configured to hold the developer for replenishing the second supply member. The first supply member and the second supply member rotate so that the surfaces thereof move in the same direction at their opposed parts.

According to this aspect of the invention, the image quality is improved.

DETAILED DESCRIPTION OF EMBODIMENTS

Figure 1:
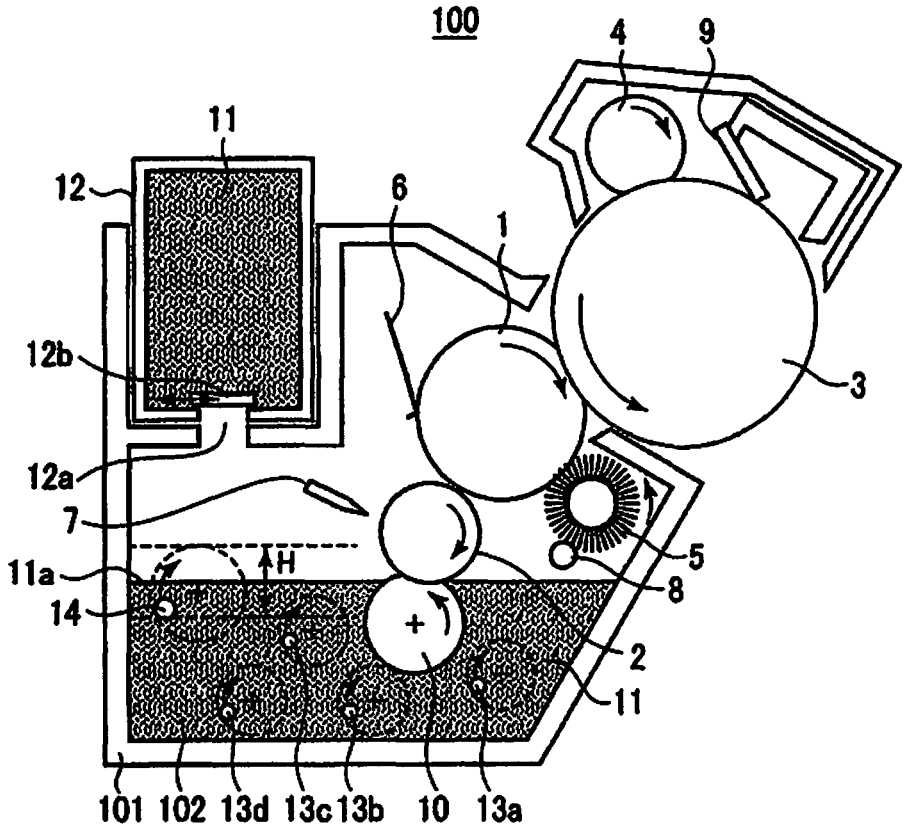
FIG. 1 is a cross-sectional view illustrating the configuration of a development device according to the first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

First, description is given of the configuration of development device 100 according to the first embodiment of the invention. FIG. 1 is a cross-sectional view illustrating the configuration of development device 100. Development device (also referred to as a process unit) 100 includes photosensitive drum 3 as an electrostatic latent image carrier inside its casing 101. Photosensitive drum 3 is a drum-shaped member comprising a photosensitive layer on the surface thereof and rotates in the counterclockwise direction in the drawing.

Development device 100 has a "drum-integrated structure" incorporating photosensitive drum 3, but it is not limited to such a structure. When a development device is constituted separately from a photosensitive drum, the entire unit including photosensitive drum 3 is referred to as a process unit (or image formation unit), and the section configured to develop an electrostatic latent image (the section from toner storage unit 12 to development roller 1 described below) are referred to as a development device.

Opposed to the surface of photosensitive drum 3 are disposed: charge roller 4 as a charge member configured to charge the surface of photosensitive drum 3 uniformly, development roller 1 as a developer carrier configured to develop an electrostatic latent image formed on the surface of photosensitive drum 3, and cleaning blade 9 as a cleaning member configured to scrape off a toner remaining on the surface of photosensitive drum 3. Charge roller 4, development roller 1, and cleaning blade 9 are disposed in this order along the rotation direction of the photosensitive drum.

In this case, charge roller 4 and cleaning blade 9 abut on the surface of photosensitive drum 3 from above. The side (right side in FIG. 1) of development roller 1 abuts on the surface of photosensitive drum 3 from diagonally below.

Development roller 1 rotates in the opposite direction to photosensitive drum 3 (in this case, in the clockwise direction in the drawing). That is, at the opposed part (or the contact part) between development roller 1 and photosensitive drum 3, the surface of development roller 1 and the surface of photosensitive drum 3 move in the same direction (in the forward direction). Charge roller 4 also rotates in the opposite direction to photosensitive drum 3 (in this case, in the clockwise direction in the drawing).

Opposed to development roller 1, development blade 6 as a developer regulation member is disposed. Development blade 6 is configured to regulate the thickness of a thin layer (described below) of the toner formed on the surface of development roller 1.

Further, toner supply roller 2 as a first supply member is provided opposed to and in non-contact with development roller 1. Toner supply roller 2 is located approximately below development roller 1. In the rotation direction of development roller 1, toner supply roller 2 is located upstream of development blade 6 and downstream of photosensitive drum 3.

Toner supply roller 2 rotates in the same direction as development roller 1 (in this case, in the clockwise direction in the drawing). In other words, toner supply roller 2 and development roller 1 each rotate so as to move in the directions opposite to each other at a part where rollers 1 and 2 are opposed to each other.

Auxiliary supply roller 10 as a second supply member is provided in contact with toner supply roller 2. Auxiliary supply roller 10 is located below toner supply roller 2. Auxiliary supply roller 10 rotates in the opposite direction to toner supply roller 2 (in this case, in the counterclockwise direction in the drawing). That is, at the opposed part between auxiliary supply roller 10 and toner supply roller 2, the surface of auxiliary supply roller 10 and the surface of toner supply roller 2 move in the same direction.

This auxiliary supply roller 10 is disposed in the lower portion of casing 101, and the toner as a developer deposits in the lower portion of casing 101. The lower portion of casing 101 is referred to as developer holder 102 configured to hold toner (developer) 11.

In order to replenish developer holder 102 in casing 101 with toner 11, toner storage unit 12 as a developer storage unit is provided in the upper portion of casing 101. Toner storage unit 12 is a storage vessel capable of storing toner 11 inside thereof (for example, a toner cartridge). Toner replenishment opening 12*a* as a developer replenishment opening configured to supply toner 11 into casing 101 (developer holder 102) is formed at the lower portion of toner storage unit 12, and shutter 12*b* configured to open and close toner replenishment opening 12*a* is provided thereto.

Further, opposed to development roller 1, toner collection brush roller 5 is disposed as a developer collection member configured to recover the toner remaining on the surface of development roller 1 (the toner which is not used for development of the electrostatic latent image on photosensitive drum 3). In the rotation direction of development roller 1, toner collection brush roller 5 is located upstream of toner supply roller 2 and downstream of photosensitive drum 3.

Opposed to toner collection brush roller 5, flicker 8 for a toner collection brush is disposed as a flicker member configured to flick the toner carried by toner collection brush roller 5.

Opposed to and in non-contact with toner supply roller 2, saw-tooth electrode 7 is disposed as a charge assistant member configured to charge the toner on the surface of toner supply roller 2. In the rotation direction of toner supply roller 2, saw-tooth electrode 7 is located downstream of auxiliary supply roller 10 and upstream of development roller 1.

In the lower portion of casing 101 (i.e., in developer holder 102), stir members 13*a*, 13*b*, 13*c*, and 13*d* configured to stir and convey toner 11 are provided. The stir member is, for example, a metal bar having a crank shape, and stir members 13*a*, 13*b*, 13*c*, and 13*d* (in this case, four stir members) are disposed so that each axial direction is parallel to the axial direction of development roller 1.

Furthermore, toner remainder detection bar 14 as a detector is provided in order to detect toner level (upper surface level of toner 11) 11*a* in developer holder 102 of casing 101. Toner remainder detection bar 19 is a metal bar having a crank shape and is described in detail below.

Figure 2A:
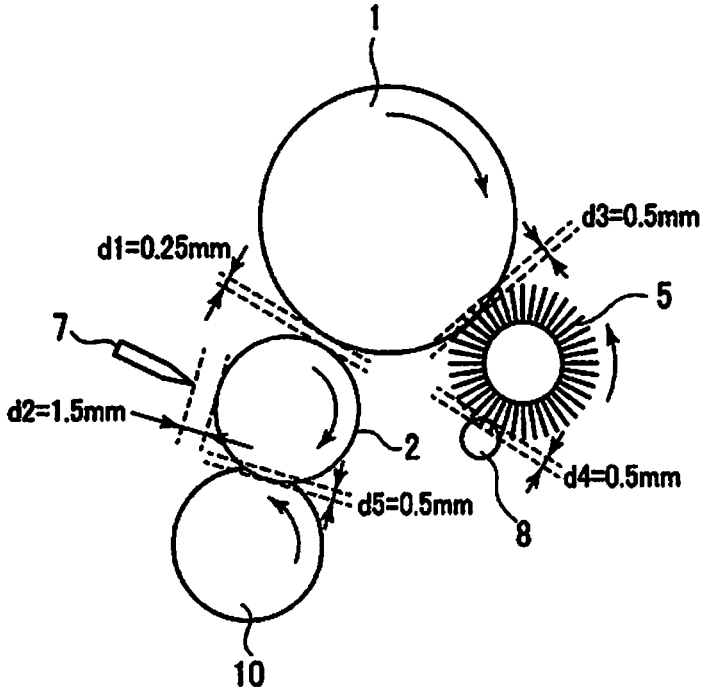
FIG. 2A is a schematic diagram illustrating the nip amount and the gap amount between respective rollers.

FIG. 2A is a schematic diagram illustrating the nip amount and the gap amount between respective rollers of development device 100. As shown in FIG. 2A, gap d1 between development roller 1 and toner supply roller 2 is 0.25 mm. Gap d2 between toner supply roller 2 and the tip of saw-tooth electrode 7 is 1.5 mm.

Development roller 1 and toner collection brush roller 5 are in contact with each other, and nip amount d3 is 0.5 mm. Toner collection brush roller 5 and flicker 8 for a toner collection brush are in contact with each other, and nip amount d4 is 0.5 mm. Toner supply roller 2 and auxiliary supply roller 10 are in contact with each other, and nip amount d5 is 0.5 mm. It is noted that the nip amount is obtained by subtracting the total radius of two rollers from the center distance of respective rollers.

Figure 2B:
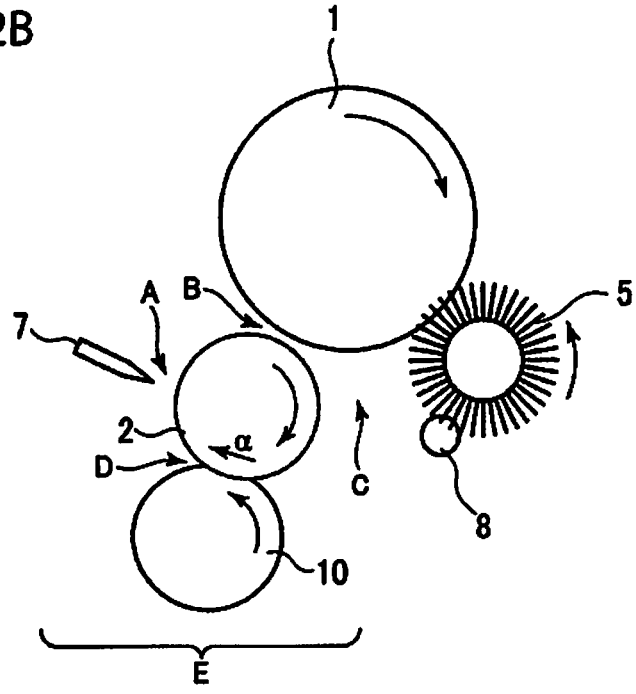
FIG. 2B is a schematic diagram describing the positional relationship between a toner supply roller and surrounding rollers in the development device according to the first embodiment.

FIG. 2B is a schematic diagram for describing the positional relationship between toner supply roller 2 and surrounding rollers of development device 100. In FIG. 2B, a part portion where toner supply roller 2 and saw-tooth electrode 7 are opposed to each other (opposed part) is indicated by reference letter A, and the opposed part between toner supply roller 2 and development roller 1 is indicated by reference letter B. In addition, the opposed part between toner supply roller 2 and toner collection brush roller 5 is indicated by reference letter C, and the opposed part between toner supply roller 2 and auxiliary supply roller 10 is indicated by reference letter D.

In the rotation direction of toner supply roller 2, opposed part A between toner supply roller 2 and saw-tooth electrode 7 is located upstream of opposed part B between toner supply roller 2 and development roller 1. Further, opposed part B between toner supply roller 2 and development roller 1 is located upstream of opposed part C between toner supply roller 2 and toner collection brush roller 5.

The moving direction (indicated by arrow α in FIG. 2B) of toner supply roller 2 and auxiliary supply roller 3 at opposed part D of each other is the direction from the toner collection brush roller 5 side (right side in the drawing) toward the toner storage unit 12 (FIG. 1) side (left side in the drawing).

A portion for toner replenishment from toner storage unit 12 (through toner replenishment opening 12*a*) shown in FIG. 1 is located outside area E including opposed parts A, B, and D described above (in this case, outside in the horizontal direction).

Figure 3:
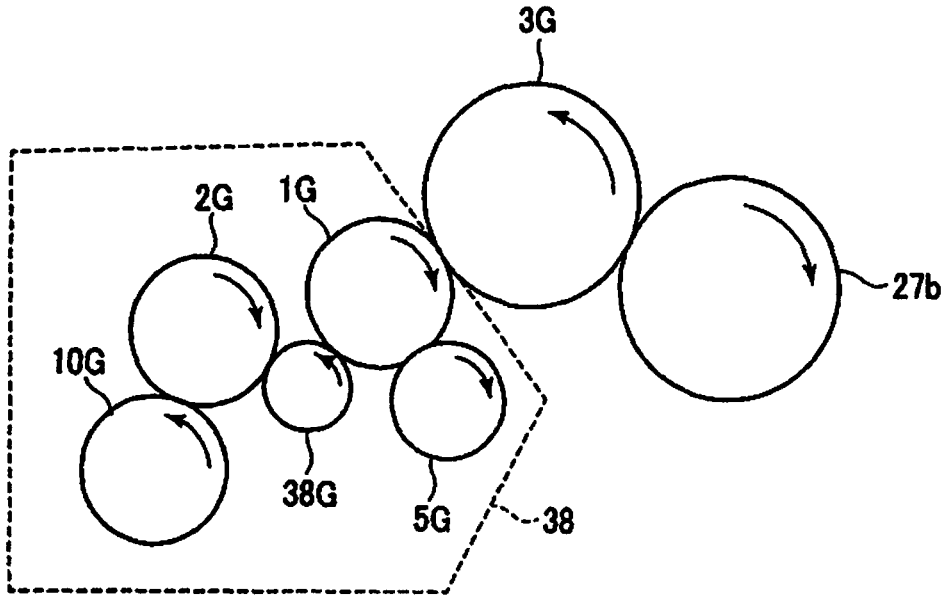
FIG. 3 is a schematic diagram illustrating the configuration of a drive transmission unit of the development device according to the first embodiment.

FIG. 3 is a schematic diagram illustrating the configuration of drive transmission unit 38 of development device 100. The shaft parts of photosensitive drum 3, development roller 1, toner supply roller 2, auxiliary supply roller 10, and toner collection brush roller 5, as described above, are provided with photosensitive drum gear 3G, development roller gear 1G, toner supply roller gear 2G, auxiliary supply roller gear 10G, and collection roller gear 5G, respectively.

Motor gear 27*b* provided on drive motor 27 (FIG. 8) is in mesh with photosensitive drum gear 3G. Photosensitive drum gear 3G is in mesh with development roller gear 1G. Development roller gear 1G is in mesh with idle gear 38G and collection roller gear 5G. Idle gear 38G is in mesh with toner supply roller gear 2G, and toner supply roller gear 2G is in mesh with auxiliary supply roller gear 10G.

With such a configuration, the rotation (driving force) of drive motor 27 is transmitted to photosensitive drum 3, development roller 1, toner supply roller 2, auxiliary supply roller 10, and toner collection brush roller 5, which then rotate in respective directions indicated by the arrows.

Further, the driving force is transmitted to stir members 13*a*, 13*b*, 13*c*, and 13*d* illustrated in FIG. 1 via drive transmission unit 38. Further, a gear train and the stir members rotate, for example, in the clockwise direction shown in FIG. 1.

Figure 4:
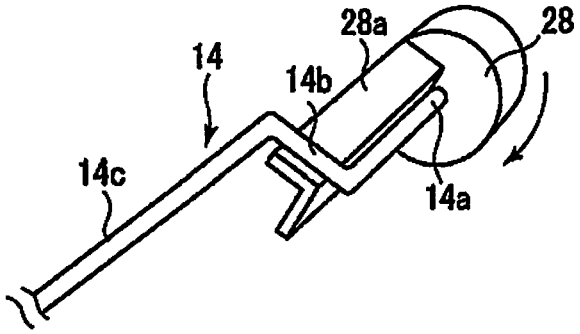
FIG. 4 is a perspective view illustrating the shape of the end of a toner remainder detection bar of the development device according to the first embodiment.
Figure 5:
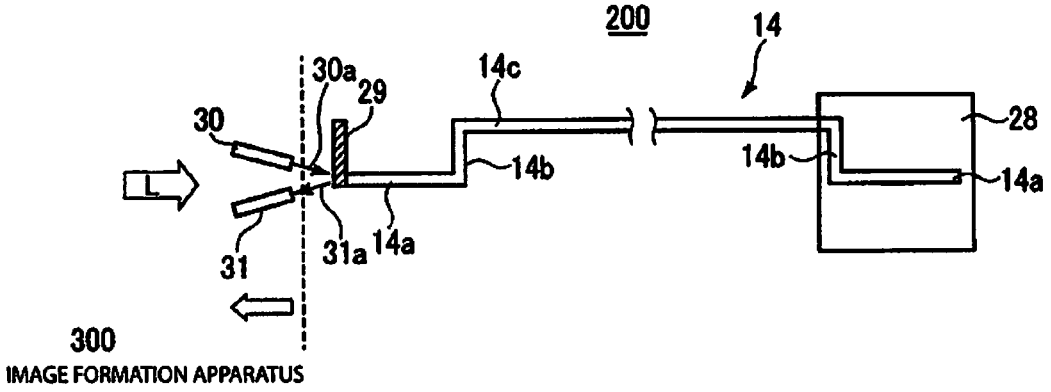
FIG. 5 is a diagram illustrating a toner remainder detection mechanism including the toner remainder detection bar of the development device according to the first embodiment.

FIG. 4 is a perspective view illustrating the shape of the end of toner remainder detection bar 14 shown in FIG. 1. FIG. 5 is a drawing illustrating the configuration of toner remainder detection mechanism 200 including toner remainder detection bar 14. Toner remainder detection bar 14 includes shaft part 14*a* located at the end thereof in the rotational axis direction, with a radius part 14*b* bending from shaft part 14*a* and extending in the rotational radius direction. Center part 14*c* is located at the center of toner remainder detection bar in the rotational axis direction and extends in the rotational axis direction.

Shaft part 14*a* of toner remainder detection bar 14 is inserted in gear 28 configured to rotate toner remainder detection bar 14. It is noted that toner remainder detection bar 14 is free with respect to the rotation of gear 28.

Gear 28 is provided with abutment part 28*a* configured to abut on radius part 14*b* of toner remainder detection bar 14. Abutment part 28*a* has an L-shaped cross section and a predetermined length in the rotational axis direction of toner remainder detection bar 14.

Gear 28 receives the driving force of drive motor 27 shown in FIG. 3 through drive transmission unit 38 and a gear train, not shown. Gear 28 rotates at a constant speed in the direction indicated by the arrow in FIG. 4 with the rotation of photosensitive drum 3. When gear 28 rotates, abutment part 28*a* applies a force to toner remainder detection bar 14 in the rotation direction, whereby toner remainder detection bar 14 rotates in the same direction as gear 28.

The rotation speed of gear 28 is set lower than the speed at which toner remainder detection bar 14 rotates downward (falls) from the top of the rotation path due to its own weight.

As shown in FIG. 5, of shaft parts 14*a* at both ends of toner remainder detection bar 14, shaft part 14*a*, which is opposite to the gear 28 side, projects outward from development device 100. At the tip of shaft part 14*a* projecting outward from development device 100, reflector 29 as a detected member is fixed. Reflector 29 rotates with the rotation of toner remainder detection bar 14.

Reflector 29 can desirably reflect a laser beam, and a mirror is used as reflector 29 in the embodiment. The body of image formation apparatus 300, described below, comprises light emitter 30 configured to emit laser beam 30*a*, and light receiver 31 configured to receive reflected light 31*a* which is emitted from light emitter 30 and reflected by reflector 29.

Figure 6:
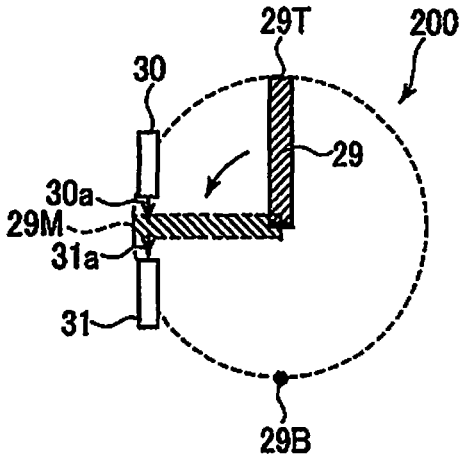
FIG. 6 is a diagram of the toner remainder detection mechanism of the development device according to the first embodiment as viewed in the direction of arrow L shown in FIG. 5.

FIG. 6 is a drawing of toner remainder detection mechanism 200 shown in FIG. 5, as viewed from the direction of arrow L. As shown in FIG. 6, light emitter 30 and light receiver 31 are disposed so that light receiver 31 can receive reflected light 31*a* of light 30*a* emitted from light emitter 30 only while reflector 29 passes through halfway point 29M between top 29T and bottom 29B of the rotation path in moving from top 29T to bottom 29B.

Next, image formation apparatus 300 comprising development device 100 according to the first embodiment is described.

Figure 7:
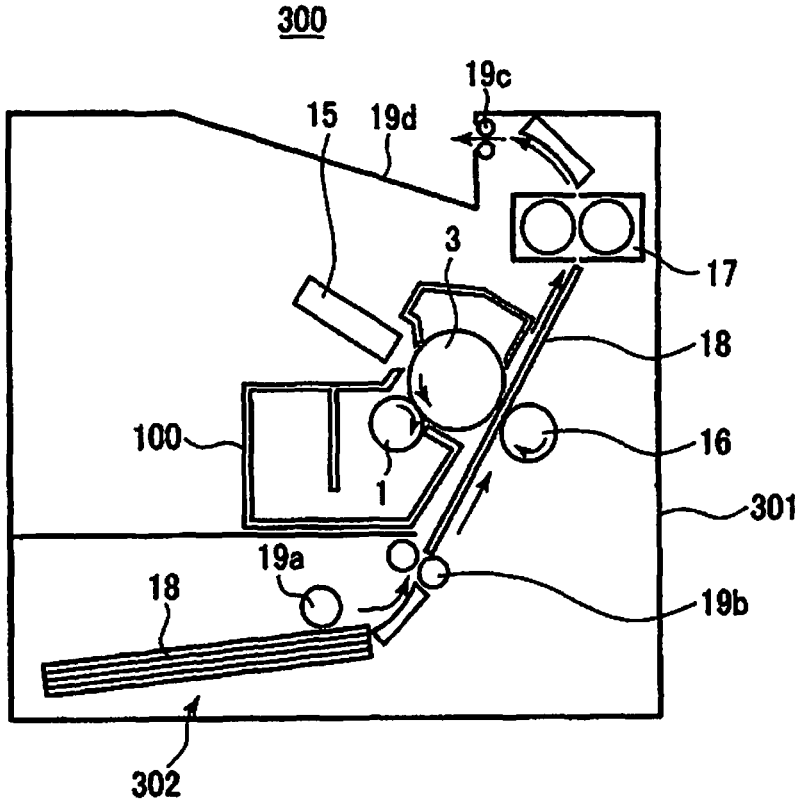
FIG. 7 is a diagram illustrating the basic configuration of the image formation apparatus comprising the development device according to the first embodiment.

FIG. 7 is a drawing illustrating the basic configuration of image formation apparatus 300. Image formation apparatus 300 is an electrophotographic printer. Image formation apparatus 300 includes medium accommodation unit 302 (for example, a tray) configured to accommodate medium 18, such as printing paper, in the lower portion of body 301.

Conveyance roller 19*a* as a paper feed unit is disposed in contact with the surface of the medium accommodated in medium accommodation unit 302. Conveyance motor 26, described below, rotatably drives conveyance roller 19*a*, which then feeds out each medium 18 accommodated in medium accommodation unit 302 one by one.

Adjacent to conveyance roller 19*a*, conveyance roller pair 19*b* is disposed as a conveyance unit configured to further convey medium 18 fed from medium accommodation unit 302 by conveyance roller 19*a*. In this case, conveyance roller pair 19*b* conveys medium 18 fed out from medium accommodation unit 302 diagonally upward (upper right direction in the drawing).

Development device 100 described above is disposed downstream of conveyance roller pair 19*b* in the conveyance direction of medium 18. Further, transfer roller 16 as a transfer member is disposed opposed to photosensitive drum 3 of development device 10 across medium 18. Transfer roller 16 transfers a toner image (developer image) formed on the surface of photosensitive drum 3 to medium 18.

LED head 15 as an exposure device is disposed on the opposite side of transfer roller 16 with respect to photosensitive drum 3 of development device 10. LED head 15 allows a photosensitive layer of the surface of photosensitive drum 3 to be exposed to light according to the image data, thereby forming an electrostatic latent image.

Fixer 17 as a fixation unit is disposed downstream of development device 100 in the conveyance direction of medium 18. Fixer 17 fixes the toner image to medium 18 by pressurizing and heating medium 18 to which the toner image is transferred, and comprises a heat source (heater) configured to melt the toner, a temperature sensor configured to detect the temperature, and others.

Conveyance roller pair 19*c* as an ejection unit configured to eject outside the device medium 18 having the toner image fixed thereon is disposed downstream of fixer 17 in the conveyance direction of medium 18. Stacker part 19*d* on which medium 18, ejected by conveyance roller pair 19*c*, is placed is provided at the upper portion of image formation apparatus 300.

Figure 8:
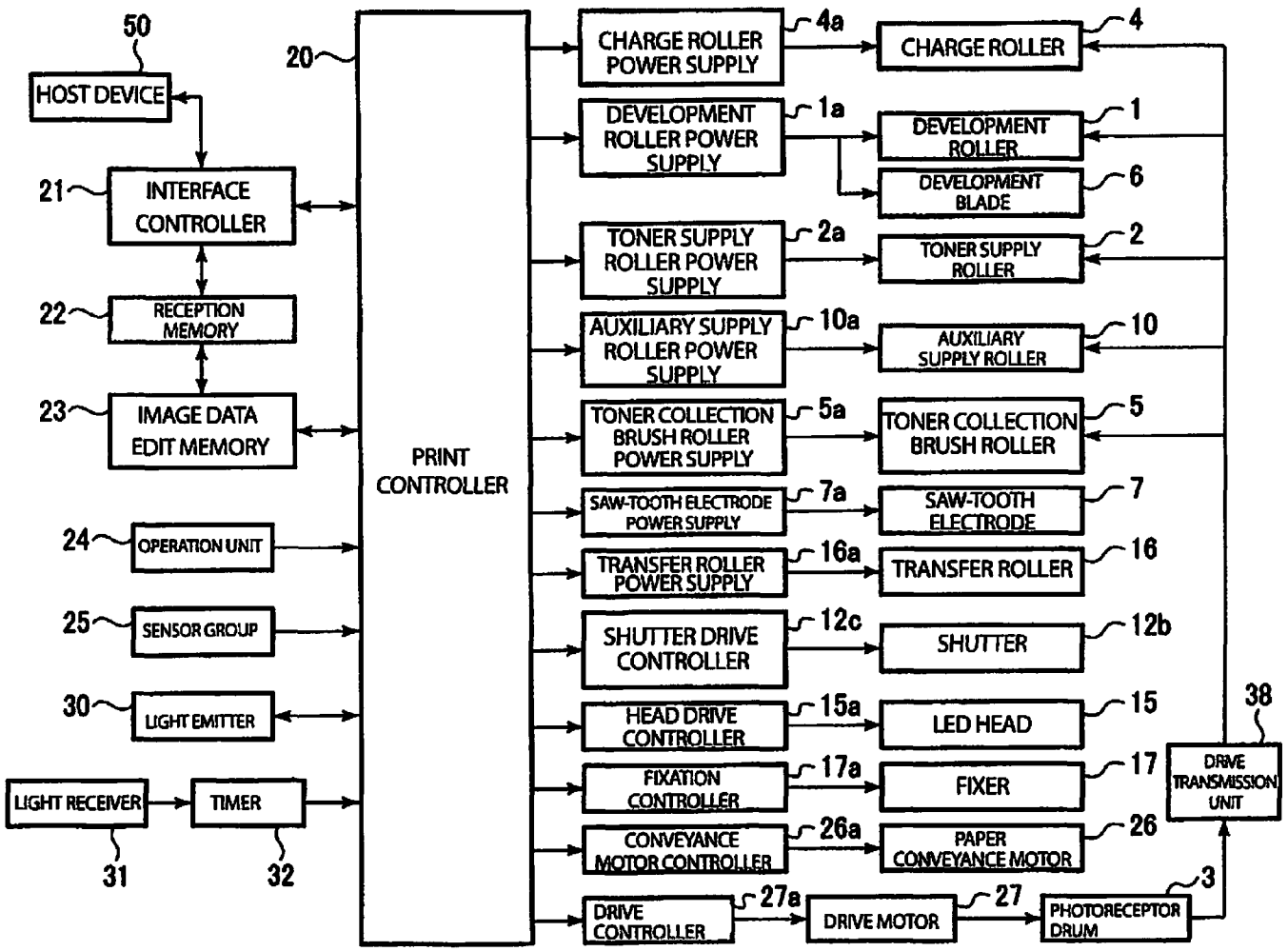
FIG. 8 is a block diagram illustrating a control system of the image formation apparatus comprising the development device according to the first embodiment.

FIG. 8 is a block diagram illustrating the control system of image formation apparatus 300. Print controller 20 configured to control image formation apparatus 300 comprises a microprocessor, ROM, RAM, an input/output port, a timer, and others. Print controller 20 controls the sequence of image formation apparatus 300 based on the print data and the control command which are sent from host device 50, such as a personal computer, to execute image formation operation.

Interface (I/F) controller 21 includes an interface connector (IC) for an interface, and others, and receives the print data and the control command which are sent from host device 50 and transfers them to print controller 20.

Reception memory 22 temporarily records the print data inputted from host device 50 via interface controller 21. Image data edit memory 23 receives the print data recorded in reception memory 22, edits the print data, and records image data thus generated.

Operation unit 24 includes a display unit (for example, a LED) configured to display the state of image formation apparatus 300, and an input unit (for example, including a switch, a display unit, and others) to which the instruction of an operator is inputted for image formation apparatus 300.

Sensor group 25 includes various kinds of sensors configured to monitor the operational state of image formation apparatus 300, such as, for example, a medium position detection sensor, a temperature/humidity sensor, a printing density sensor, and a toner remainder detection sensor.

Timer 32 is configured to measure the time for light receiver 31 to detect reflected light 31*a* which is emitted from light emitter 30 and reflected by reflector 29.

Charge roller power supply 4*a* applies a predetermined charge voltage to charge roller 4 which is configured to uniformly charge the surface of photosensitive drum 3 based on the instruction of print controller 20. Development roller power supply la applies a predetermined development voltage to development roller 1 configured to develop the electrostatic latent image on photosensitive drum 3. Development roller power supply 1*a* also applies a predetermined voltage to development blade 6.

Toner supply roller power supply 2*a* applies a predetermined voltage to toner supply roller 2 configured to supply toner 11 to development roller 1. Auxiliary supply roller power supply 10*a* applies a predetermined voltage to auxiliary supply roller 10 which is configured to supply a toner to toner supply roller 2 and charge toner 11.

Toner collection brush roller power supply 5*a* applies a predetermined voltage to toner collection brush roller 5 configured to recover toner 11 from development roller 1. Saw-tooth electrode power supply 7*a* applies a predetermined voltage to saw-tooth electrode 7 (charge assistant member) configured to charge toner 11. Transfer roller power supply 16*a* applies a predetermined transfer voltage to transfer roller 16 configured to transfer the toner image on photosensitive drum 3 to medium 18.

The voltage applied to charge roller power supply 4*a*, development roller power supply 1*a*, toner supply roller power supply 2*a*, auxiliary supply roller power supply 10*a*, toner collection brush roller power supply 5*a*, saw-tooth electrode power supply 7*a*, and transfer roller power supply 16*a* can be changed by the instruction of print controller 20.

Head drive controller 15*a* sends the image data recorded in image data edit memory 23 to LED head 15 and drives LED head 15.

Fixation controller 17*a* applies a voltage to the heater of fixer 17 in order to fix the toner image transferred to medium 18 onto medium 18. Specifically, fixation controller 17*a* performs a control to keep fixer 17 at a constant temperature by reading the sensor output of the temperature sensor provided in fixer 17 and energizing the heater based on the sensor output.

Conveyance motor controller 26*a* controls conveyance motor 26 configured to convey medium 18 based on the instruction of print controller 20. Accordingly, each medium accommodated in medium accommodation unit 302 is fed out to a conveyance path one by one by conveyance roller 19*a*, passed through development device 100 by conveyance roller pair 19*b*, and ejected out of the device by conveyance roller pair 19*c*.

Drive controller 27*a* controls drive motor 27 configured to rotate photosensitive drum 3. The rotation of drive motor 27 causes a rotation of each of photosensitive drum 3, development roller 1, toner supply roller 2, auxiliary supply roller 10, toner collection brush roller 5, stir members 13*a*, 13*b*, 13*c*, and 13*d*, and toner remainder detection bar 14 by drive transmission unit 38 described above.

Shutter drive controller (replenishment controller) 12*c* controls the opening and closing of shutter 12*b* of toner storage unit 12. Shutter drive controller 12*c* detects toner level 11*a* (FIG. 1) in casing 101 by toner remainder detection mechanism 200, and performs a control to open shutter 12*b* and replenish casing 101 with the toner from toner storage unit 12 when the remainder of the toner in casing 101 is low.

Next, the preferred operating conditions of development device 100 according to the first embodiment are described. The operating conditions described here correspond to the conditions of the print tests (FIG. 17 and FIG. 18) described below.

First, a description is given of toner 11. The toner 11 used herein is a negatively charged toner of a non-magnetic one component, manufactured by a grinding technique and using polyester resin as a binder. Toner 11 has a volume average particle size of 5.7 μm, a circularity of 0.92, and a blow-off charged amount of −36 μC/g.

The volume average particle size is measured using a "Coulter Multisizer II" produced by Beckman Coulter, Inc. Further, the circularity is measured using a flow particle image analyzer "FPIA-3000" produced by Sysmex Corporation.

The blow-off charged amount is measured using a powder charged amount measurement device TYPE TB-203" produced by KYOCERA Corporation. For measurement, 0.5 g of the toner and 9.5 g of ferrite carrier (F-60) produced by Powdertech are mixed and stirred for 30 minutes, and then the saturation charged amount is measured at a blow pressure of 7.0 kPa and a suction pressure of −4.5 kPa.

Figure 9:
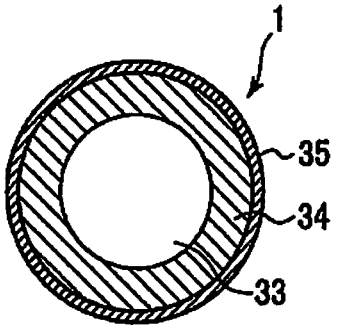
FIG. 9 is a diagram illustrating the cross-sectional structure of the development roller of the development device according to the first embodiment.

Next, a description is given of respective rollers and the blade. FIG. 9 is a diagram illustrating the cross-sectional structure of development roller 1. Development roller 1 includes cored bar 33 having conductivity, elastic layer 34 formed on the surface of cored bar 33, and semi-conductive resin film 35 coated on the surface of elastic layer 34. Elastic layer 34 can be formed of a general rubber material such as silicone rubber and polyurethane rubber, for example. In this case, elastic layer 34 is formed of silicone rubber. In consideration of the ability to charge toner 11, semi-conductive resin film 35 is made of an acrylic resin with carbon black and the like dispersed therein.

Elastic layer 34 suitably has a rubber hardness of 50° to 80° in Asker C hardness, and has 60° in Asker C hardness in this case.

Development blade 6 is made of stainless steel (SUS), and has a board thickness of 0.08 mm, for example. In addition, the abutment part of development blade 6 with development roller 1 is bent. In this case, the radius of curvature R of the bent portion is set to 0.18 mm, and the linear pressure against development roller 1 is set to 35 gf/cm.

In addition to the conditions of development blade 6, the surface roughness and the resistance of development roller 1 are responsible for determining the toner layer thickness formed on development roller 1 and the toner charged amount. In this case, the surface of development roller 1 has a ten-point average roughness Rz (JIS B0601-1994) of 2 to 8 μm. The surface roughness is measured with a "Surfcorder SEF3500" produced by Kosaka Laboratory Ltd. The measurement instrument has a stylus radius of 2 μm, a stylus pressure of 0.7 mN, and a stylus traveling speed of 0.1 mm/sec.

Figure 10A:
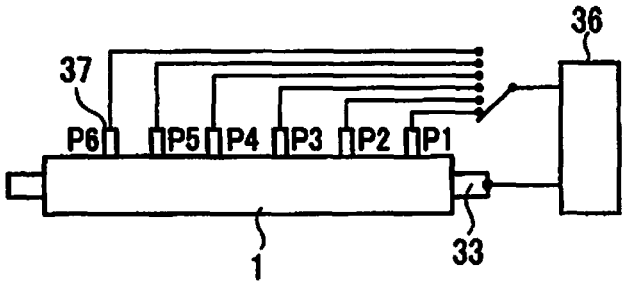
FIG. 10A is a front view and FIG. 10B is a side view of the development roller of the development device according to the first embodiment to describe the method for measuring the resistance of the development roller.
Figure 10B:
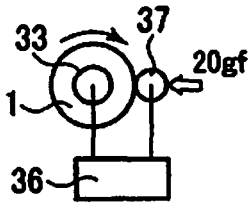

Further, development roller 1 preferably has a resistance in the range of $1\times10^6$ to $1\times10^9$ Ω, including elastic layer 34 and semi-conductive resin film 35. FIG. 10A is a front view and FIG. 10B is a side view of development roller 1 to describe the method for measuring the resistance of development roller 1. For measurement device 36 for the resistance of development roller 1, a "High Resistance Meter (4339B)" produced by Hewlett-Packard Company is used.

Ball bearings 37, each having a width of 2.0 mm and a diameter of 6.0 mm, and made of stainless steel (SUS), are brought into contact with the peripheral surface of development roller 1 at a force of 20 gf. The resistance between cored bar 33 and the roller surface (semi-conductive resin film 35) is measured with measurement device 36. Bearings 37 are provided at six locations (from P1 to P6 shown in FIG. 10A) of development roller 1 in the axial direction, and the resistance between cored bar 33 and the roller surface is measured with rotation of development roller 1 at a speed of 50 rpm. The resistance is measured from P1 to P6 each at 100 points along the circumference of developing roller 1, i.e., 600 points in total, and the mean thereof is defined as the resistance of the roller. The applied voltage to development roller 1 at this time is set to 100 V.

Toner supply roller 2 is made of aluminum and has an outer diameter of 12.5 mm. The surface processing of toner supply roller 2 to have a surface roughness (ten-point average roughness) Rz of 1 μm or less secures the releasability of the toner (i.e., an ease of moving the toner to development roller 1) from the surface of toner supply roller 2.

Toner collection brush roller 5 is constituted by spirally wrapping a textile, in which a conductive fiber (brush fiber) with a desirably adjusted resistance is woven, around the conductive cored bar. Toner collection brush roller 5 desirably has a resistance in the range of $1\times10^6$ to $1\times10^8$ Ω at an applied voltage of 50 V according to the method for measurement described with reference to FIG. 10. This is because toner collection brush roller 5 having a resistance higher than the above range causes an accumulation of charge in the brush fiber to prevent the discharge of undeveloped toner on development roller 1.

The brush fiber of toner collection brush roller 5 has a length of 3 mm, a fineness (thickness) of 6 deniers, and an implantation density of 75 KF/inch$^2$. Further, as a material of the brush fiber, acrylic fiber (SA-7 material produced by Toray Industries, Inc.) is used.

Flicker 8 for a toner collection brush is disposed to abut on toner collection brush roller 5 in order to flick (travel) the toner carried by toner collection brush roller 5 (i.e., toner recovered from development roller 1) utilizing the elasticity of the brush fiber.

Flicker 8 for a toner collection brush is a cylindrical bar made of metal with a cross-sectional diameter of 3 mm, and as shown in FIG. 2, it is pushed into toner collection brush roller 5 by 0.5 mm.

The shape of flicker 8 for a toner collection brush is not only a cylinder but also can be a metal plate having a thickness of about 0.1 mm. However, the brush fiber of toner collection brush roller 5 is easily worn out when the metal plate has an edge at the tip thereof. Therefore, it is desirable that the tip be bent and that the bent portion abut on toner collection brush roller 5.

Auxiliary supply roller 10 is made by providing a silicone rubber sponge on the surface of the conductive cored bar. The silicone rubber sponge is obtained by molding an unvulcanized silicone rubber compound by a method such as extrusion and carrying out vulcanization foaming with heating.

The silicone rubber compound is obtained by adding a reinforcing silica filler, a vulcanizing agent required for vulcanization/curing, and a foaming agent to various raw rubbers such as dimethyl silicone raw rubber and methylphenyl silicone raw rubber. As a foaming agent, an inorganic foaming agent such as sodium bicarbonate and an organic foaming agent such as ADCA are used. In addition, acetylene black, carbon black, and the like are added when semi-conductivity is imparted.

Auxiliary supply roller 10 has cells (fine pores generated by foaming) each having a diameter of 200 to 500 μm, and has an Asker F hardness in the range of 50 to 80 degrees. The hardness of auxiliary supply roller 10 can be adjusted by the amount of the vulcanizing agent added.

Auxiliary supply roller 10 desirably has a resistance in the range of $1\times10^7$ to $1\times10^{10}$ Ω at an applied voltage of 100 V according to the method for measurement described with reference to FIG. 10. In this case, the resistance is set to $1\times10^9$ Ω. Auxiliary supply roller 10 having a resistance lower than the above range causes a larger current value between auxiliary supply roller 10 and toner supply roller 2, thereby making it difficult to apply a desired voltage.

Auxiliary supply roller 10 abuts on toner supply roller 2 and rotates in the opposite direction to toner supply roller 2 as described with reference to FIG. 1. However, in order to prevent the toner from being damaged by friction with toner supply roller 2 at the abutment part, auxiliary supply roller 10 and toner supply roller 2 rotate so that the surfaces thereof move in the same direction at substantially the same speed at the abutment part.

As used herein, "substantially the same speed" means that the difference (V10−V2) between movement speed V10 of the surface of auxiliary supply roller 10 and movement speed V2 of the surface of toner supply roller 2 at the abutment part of auxiliary supply roller 10 and toner supply roller 2 is within ±10% of V10.

Figure 11:
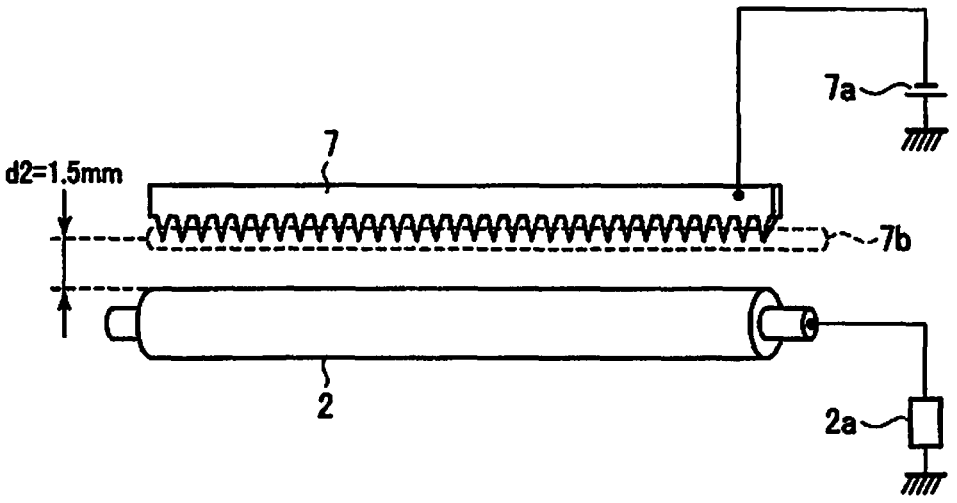
FIG. 11 is a schematic diagram illustrating the shape of a saw-tooth electrode and the positional relationship thereof with the toner supply roller according to the first embodiment.

FIG. 11 is a schematic diagram illustrating the shape of saw-tooth electrode (charge assistant member) 7, and the positional relationship thereof with toner supply roller 2. Saw-tooth electrode 7 is an elongated member which is long in the axial direction of toner supply roller 2 and is made of stainless steel (SUS). Saw-tooth electrode 7 has protrusions 7*b* projecting toward toner supply roller 2. These protrusions 7*b* are disposed at regular intervals along the longitudinal direction of saw-tooth electrode 7.

Protrusions 7*b* of saw-tooth electrode 7 are disposed opposed to, and in non-contact with, toner supply roller 2. Further, saw-tooth electrode 7 is connected to saw-tooth electrode power supply 7*a* (charge assistant member power supply) and receives application of a bias voltage as describe below.

It is noted that the charge assistant member in the embodiment is not limited to saw-tooth electrode 7. For example, like a urethane film, a PET film, or others, the charge assistant member may be a film-shaped resin with a conductive agent such as carbon black mixed therein, and the surface of the charge assistant member can be brought into slight contact with toner supply roller 2 to apply a voltage thereto.

As used herein, "slight contact" means that, in order to suppress the toner damage due to friction, (Tb—Ta) is 5% or less of Ta, wherein Ta represents the load torque on drive motor 27 when the charge assistant member is not brought into contact with toner supply roller 2, and Tb represents the load torque on drive motor 27 when the charge assistant member is brought into contact with toner supply roller 2.

Next, with reference to FIGS. 1 to 3, and FIGS. 7 and 8, the image formation operation of image formation apparatus 300 of the embodiment is described.

When print controller 20 of image formation apparatus 300 receives a printing instruction from host device 50 such as a personal computer, print controller 20 controls drive controller 27*a* so that drive motor 27 is driven to rotate photosensitive drum 3 at a constant peripheral speed in the direction of the arrow shown in FIG. 1. The driving force of drive motor 27 is further transmitted by drive transmission unit 38 (FIG. 2A) to rotate development roller 1, toner supply roller 2, toner collection brush roller 5, and auxiliary supply roller 10 in the directions of the arrows, respectively.

Further, rotation of drive motor 27 is transmitted to stir members 13*a*, 13*b*, 13*c*, and 13*d* and toner remainder detection bar 14 through drive transmission unit 38 and the gear train not shown. Accordingly, stir members 13*a*, 13*b*, 13*c*, and 13*d* and toner remainder detection bar 19 rotate in the directions of the arrows shown in FIG. 1.

Charge roller 4 is driven to rotate by applying a charged voltage (DC) thereto from charge roller power supply 4*a* and being in contact with the surface of photosensitive drum 3 by pressure. Accordingly, the surface of photosensitive drum 3 is charged uniformly.

Next, control of head drive controller 15*a* allows LED head 15 to emit light based on the image data, thereby exposing the surface of photosensitive drum 3 to light to form an electrostatic latent image.

The electrostatic latent image formed on the surface of photosensitive drum 3 is subjected to toner development by development device 100 described below, thereby forming a toner image (developer image) on the surface of photosensitive drum 3.

On the other hand, each medium 18 is conveyed one by one from medium accommodation unit 302 of image formation apparatus 300 to the transfer part between photosensitive drum 3 and transfer roller 16 of development device 100 by conveyance rollers 19*a* and 19*b*.

A transfer voltage is applied to transfer roller 16 by transfer roller power supply 16*a* and the toner image formed on the surface of photosensitive drum 3 is transferred to medium 18.

Medium 18 with the toner image transferred thereto is conveyed to fixer 17. Heat and pressure are applied to medium 18 in fixer 17, whereby toner 11 is allowed to melt and permeate into the fiber of medium 18 and become fixed to medium 18. Medium 18 with the toner image fixed thereto is sent out of image formation apparatus 300 by conveyance roller 19*c* and loaded onto stacker part 19*d*.

In addition, a small amount of toner 11 may remain on the surface of photosensitive drum 3 after the toner image is transferred. This residual toner 11 is scraped off and removed by cleaning blade 9. In this way, photosensitive drum 3 is utilized repeatedly.

Next, operation of development device 100 is described in detail with reference to FIGS. 1 and 2. The toner provided from toner storage unit 12 for replenishment accumulates in the lower portion (developer holder 102) of casing 101 of development device 100. Rotation of photosensitive drum 3 causes rotation of development roller 1, toner supply roller 2, toner collection brush roller 5, auxiliary supply roller 10, stir members 13*a*, 13*b*, 13*c*, and 13*d*, and toner remainder detection bar 19 in the directions of the arrows shown in FIG. 1, respectively, as described above.

At this time, auxiliary supply roller 10 rotates to draw up the toner from the lower portion (developer holder 102) of casing 101 while carrying the toner on the sponge surface and in the cells thereof and reaches the abutment part (opposed part D shown in FIG. 2B) to toner supply roller 2.

To toner supply roller 2, a DC bias voltage of −300 V is applied, and further an AC bias voltage of 600 V (peak-to-peak) is applied with a square wave frequency of 2 kHz by toner supply roller power supply 2*a*. Accordingly, a bias voltage (AC+DC) from 0 V to −600 V is applied to toner supply roller 2.

Auxiliary supply roller power supply 10*a* applies a bias voltage with an effective value of −1 kV to −4 kV to auxiliary supply roller 10 so that a constant current of about 10 μA flows from toner supply roller 2 to auxiliary supply roller 10. Specifically, the voltage following the bias voltage (AC+DC) applied to toner supply roller 2 is applied to auxiliary supply roller 10.

In this case, it is desirable that the AC voltage applied to auxiliary supply roller 10 have the same frequency, the same peak-to-peak voltage, and the same phase as the AC voltage applied to toner supply roller 2. This prevents oscillation of the electric field between toner supply roller 2 and auxiliary supply roller 10, thereby allowing toner 11 to be stably charged and moved. In this case, the same phase means that the phase angle is within ±10 degrees.

As described above, since an electric current (constant current) flows from toner supply roller 2 to auxiliary supply roller 10, negative charges move from auxiliary supply roller 10 toward toner supply roller 2 at the abutment part (opposed part D) of both rollers. At this time, negative charges move through toner 11 which is present between auxiliary supply roller 10 and toner supply roller 2.

Accordingly, the charging of toner 11 by an electric current and also the action and the image force of the electric field between auxiliary supply roller 10 and toner supply roller 2 causes toner 11 to adhere to the surface of toner supply roller 2. In this case, the charge amount retained by toner 11 (toner charged amount) is about −4 to −7 μC/g.

Along with the rotation of toner supply roller 2, toner 11 adhered to the surface of toner supply roller 2 reaches the opposed part to saw-tooth electrode (charge assistant member) 7. The bias voltage is applied to saw-tooth electrode 7 by saw-tooth electrode power supply 7*a* in synchronization with the AC voltage of toner supply roller 2 so that the potential difference between saw-tooth electrode 7 and toner supply roller 2 is −1 kV.

This potential difference between saw-tooth electrode 7 and toner supply roller 2 generates anions in the vicinity of protrusion 7*b* of saw-tooth electrode 7. The action of the electric field between saw-tooth electrode 7 and toner supply roller 2 allows toner 11 on the surface of toner supply roller 2 to be irradiated with anions. Accordingly, toner 11 is further charged without generating friction. The charged amount of toner 11 in this case is about −7 to −13 μC/g.

Further, with the rotation of toner supply roller 2, toner 11 adhered to the surface of toner supply roller 2 reaches opposed part B (see FIG. 2B) to development roller 1. A DC bias voltage of −200 V is applied to development roller 1 and development blade 6 by development roller power supply 1*a*. Accordingly, the electric field between toner supply roller 2 and development roller 1 may be an oscillating electric field from +200 V to −400 V. This oscillating electric field causes toner 11 on the surface of toner supply roller 2 to move (travel) toward development roller 1.

The toner adhered to the surface of development roller 1 is made into a thin layer by development blade 6, and then adheres to the surface of photosensitive drum 3, on which an electrostatic latent image is formed, to develop the electrostatic latent image.

On the other hand, toner 11 remaining on the surface of development roller 1 without being used for development of the electrostatic latent image reaches the nip part (toner collection area as a developer collection area) between development roller 1 and toner collection brush roller 5 by rotation of development roller 1. The DC bias voltage of −100 V is applied to toner collection brush roller 5 by power supply 5*a*. The electric field between toner collection brush roller and development rollers 1 is formed with a potential difference of +100 V.

Accordingly, at the nip part between development roller 1 and toner collection brush roller 5, toner 11 is moved to and recovered by toner collection brush roller 5 due to the action of a curved brush fiber of toner collection brush roller 5 to scrape off the toner and the action of the electric field.

At the abutment part between toner collection brush roller 5 and flicker 8 for a toner collection brush, the brush fiber is flipped by flicker 8 for a toner collection brush with rotation of toner collection brush roller 5. The toner retained by the brush fiber is flicked out of toner collection roller 5 and utilized again as toner 11 in casing 101.

Control of the toner level (upper surface level of toner 11) in casing 101 of development device 100 is now described with reference to FIGS. 12 to 15.

In development device 100 according to the embodiment, as described above, in order for the toner on toner supply roller 2 to be efficiently charged by ion irradiation from saw-tooth electrode 7 and moved to development roller 1 smoothly (without any trouble), it is desirable that the toner accumulated on the lower portion (developer holder 102) of casing 101 does not reach opposed part B between development roller 1 and toner supply roller 2 and opposed part A between saw-tooth electrode 7 and toner supply roller 2, and at the same time, auxiliary supply roller 10 to be sufficiently immersed in toner 11 accumulated in the lower portion of casing 101.

Accordingly, in the embodiment, the rotation center of toner remainder detection bar 14 is provided within the range indicated by reference letter H in FIG. 1. This is in order to control toner level 11*a* in casing 101 to certainly stay below opposed part B, between development roller 1 and toner supply roller 2, and opposed part A, between saw-tooth electrode 7 and toner supply roller 2; and at the same time, to stay equal to or higher than the rotation center of auxiliary supply roller 10.

Toner level 11*a* is made to be equal to or higher than the rotation center of auxiliary supply roller 10 because auxiliary supply roller 10 easily carries toner 11 in casing 101 by its own rotation.

Figure 12:
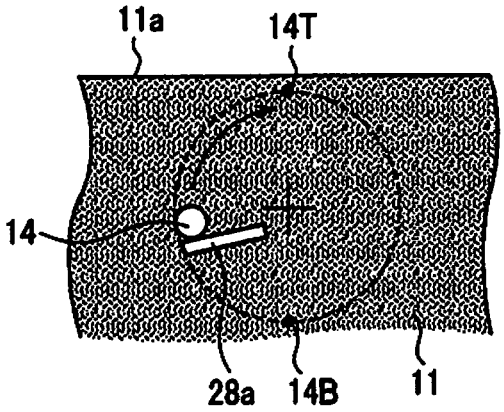
FIG. 12 is a schematic diagram illustrating the state where a toner level is higher than the top of a rotation path of the toner remainder detection bar in the first embodiment.

FIG. 12 is a schematic diagram illustrating the state where toner level 11*a* is higher than top 14T of the rotation path of toner remainder detection bar 14. In this state, the entire rotation path of toner remainder detection bar 14 is buried in toner 11. Accordingly, toner remainder detection bar 14 rotates when abutment part 28*a* of gear 28 abuts on and applies a force to radius part 14*b* of toner remainder detection bar 14. That is, toner remainder detection bar 14 rotates at the same rotation speed as gear 28.

Figure 13:
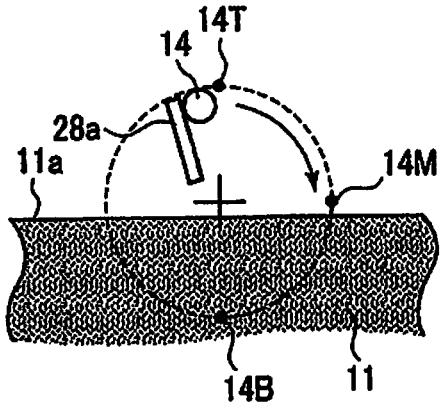
FIG. 13 is a schematic diagram illustrating the state where a toner level is lower than the top of a rotation path of the toner remainder detection bar in the first embodiment.

FIG. 13 is a schematic diagram illustrating the state where toner level 11*a* is lower than top 14T of the rotation path of toner remainder detection bar 14. In this state, toner 11 is not present in a certain area including top 19T of the rotation path of toner remainder detection bar 19. Accordingly, when toner remainder detection bar 14 reaches top 14T of the rotation path by rotation of gear 28, it falls (separating from abutment part 28*a* of gear 28) due to its own weight, whereby rotation is stopped by the resistance from toner 11 with the height of toner level 11*a*. Then, toner remainder detection bar 14 starts to rotate again at the same rotation speed as gear 28 when abutment part 28*a* of gear 28, which rotates at a constant speed, catches up with and abuts on radius part 14*b* of toner remainder detection bar 14.

Figure 14:
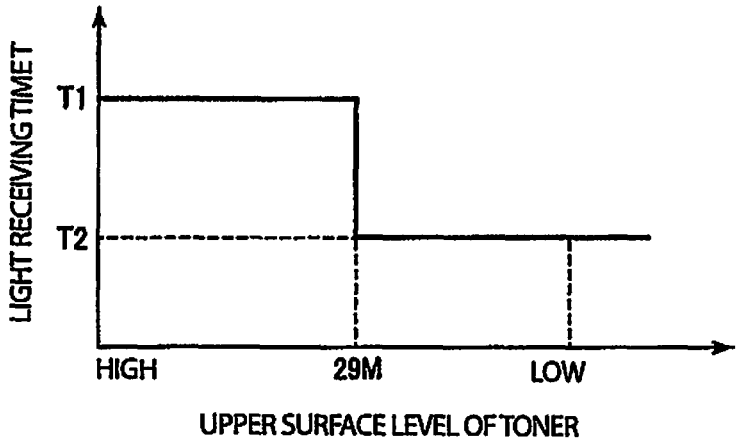
FIG. 14 is a figure showing the relationship between a toner level and a light receiving time of reflected light by a light receiver in the first embodiment.

FIG. 14 shows the relationship between toner level 11*a* and light receiving time T of reflected light 31*a* by light receiver 31 when reflector 29 passes through halfway point 29M between top 29T of, and bottom 29B of, the rotation path (FIG. 6). Halfway point 29M between top 29T and bottom 29B of the rotation path of reflector 29 corresponds to halfway point 14M between top 14T and bottom 14B of the rotation path of toner remainder detection bar 14 (FIGS. 12 and 13).

When toner level 11*a* is higher than halfway point 29M in the rotation path of reflector 29, the speed of reflector 29 to pass through halfway point 29M (toward bottom 29B) corresponds with the rotation speed of gear 28. In this case, the time for light receiver 31 to receive reflected light 31*a* (light receiving time) is defined as T1.

On the other hand, when toner level 11*a* is lower than halfway point 29M in the rotation path of reflector 29, the speed of reflector 29 to pass through halfway point 29M corresponds to the speed at which toner remainder detection bar 14 falls due to its own weight, which is faster than the rotation speed of gear 28. Accordingly, when the light receiving time of reflected light 31*a* with light receiver 31 in this case is defined as T2, the relationship between T1 and T2 satisfies T1>T2.

Accordingly, by measuring the light receiving time of reflected light 31*a* with light receiver 31, it can be judged whether toner level 11*a* is higher than halfway point 29M in the rotation path of reflector 29 (i.e., higher than the rotation center of toner remainder detection bar 14).

Figure 15:
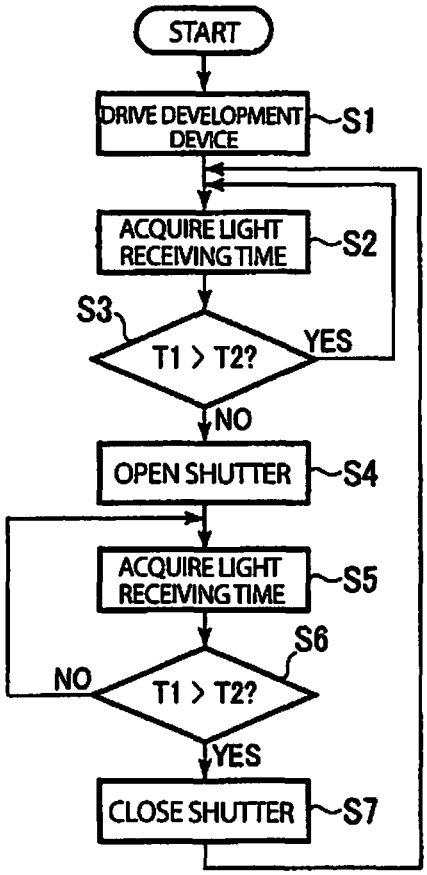
FIG. 15 is a flow chart describing the method for controlling toner replenishment in the first embodiment.

FIG. 15 is a flow chart describing the method for controlling toner replenishment. When print controller 20 of image formation apparatus 300 starts to drive development device 100 in the image formation operation (printing operation) (Step S1), it acquires light receiving time T of light receiver 31 using timer 32 (Step S2) and judges whether light receiving time T is longer than the above-mentioned T2 (Step S3).

When light receiving time T is judged to be longer than the above-mentioned T2 (YES in Step S3), development device 100 is continued to be driven with shutter 12*b* of toner storage unit 12 being closed. This is because toner level 11*a* is higher than the rotation center of toner remainder detection bar 14 and a sufficient amount of the toner remains in casing 101 in this case.

On the other hand, when light receiving time T of light receiver 31 is T2 or less (NO in Step S3), the remainder of the toner in casing 101 is judged to be low, and then shutter 12*b* of toner storage unit 12 is opened to replenish casing 101 with toner 11 from toner storage unit 12 (Step S4).

Further, print controller 20 acquires light receiving time T of light receiver 31 using timer 32 (Step S5) and judges whether light receiving time T is longer than the above-mentioned T2 (Step S6). When light receiving time T of light receiver 31 is T2 or less (NO in Step S6), toner replenishment is continued with shutter 12*b* of toner storage unit 12 being opened. On the other hand, when light receiving time T of light receiver 31 is longer than T2 (YES in Step S6), shutter 12*b* of toner storage unit 12 is closed (Step S7).

Control of toner replenishment using such a toner remainder detection mechanism 200 (toner remainder detection bar 14, reflector 29, light emitter 30, and light receiver 31) keeps toner level 11*a* in development device 100 lower than opposed part B between development roller 1 and toner supply roller 2 and opposed part A between saw-tooth electrode 7 and toner supply roller 2, as well as higher than the rotation center of auxiliary supply roller 10.

Next, a description is given of the print test with image formation apparatus 300 using development device 100 constituted as stated above.

Here, under the environment of a temperature of 23° C. and a relative humidity of 50%, the continuous print test of a white paper pattern is carried out. The reason for carrying out the continuous print test of a white paper pattern is to continuously apply friction to toner 11 by development roller 1, toner supply roller 2, auxiliary supply roller 10, saw-tooth electrode 7, toner collection brush roller 5, and others in development device 100, without moving toner 11 to the photosensitive drum 3 side.

As a result of the continuous print test, the generation status of fogging and blur (degradation of printing quality) are evaluated. These degradations of printing quality are produced by a decreased charging performance due to the separation of an external additive from the toner base particles or the burial of an external additive into the toner base particles and the lower toner supply capability due to a decrease in fluidity as a powder, which are originated from the continuous friction against toner 11.

The evaluation of fogging is carried out as follows. In short, operation of image formation apparatus 300 is stopped in the middle of the printing of a white paper pattern, and toner 11 on the surface of photosensitive drum 3 in the position after development before transfer (i.e., between the position opposed to development roller 1 and the position opposed to transfer roller 16) is adhered to an adhesive tape ("Scotch Mending Tape" produced by Sumitomo 3M Limited). This adhesive tape is removed from photosensitive drum 3 and stuck on a printing paper.

Then, separated from this, the same kind of adhesive tape which is not stuck on photosensitive drum 3 is stuck on a printing paper, and color difference ΔE between both adhesive tapes is measured with a spectrophotometer (CM2600d produced by Konica Minolta Holdings, Inc.). A smaller color difference ΔE indicates less fogging.

The evaluation of blur is carried out by printing a black solid image (100% DUTY) after the above-mentioned continuous print test of a white paper pattern and observing the printed image.

Specifically, the case where generation of blur is not observed in the solid image is defined as level 10, the case where blur accounts for less than 2% of the solid image is defined as level 9, and the case of 2% or more to less than 4% is defined as level 8. Similarly, the case where blur accounts for 4% or more to less than 6% of the solid image is defined as level 7, and the case of 6% or more to less than 8% is defined as level 6, so that the level is decreased by one stage per 2%

Figure 16:
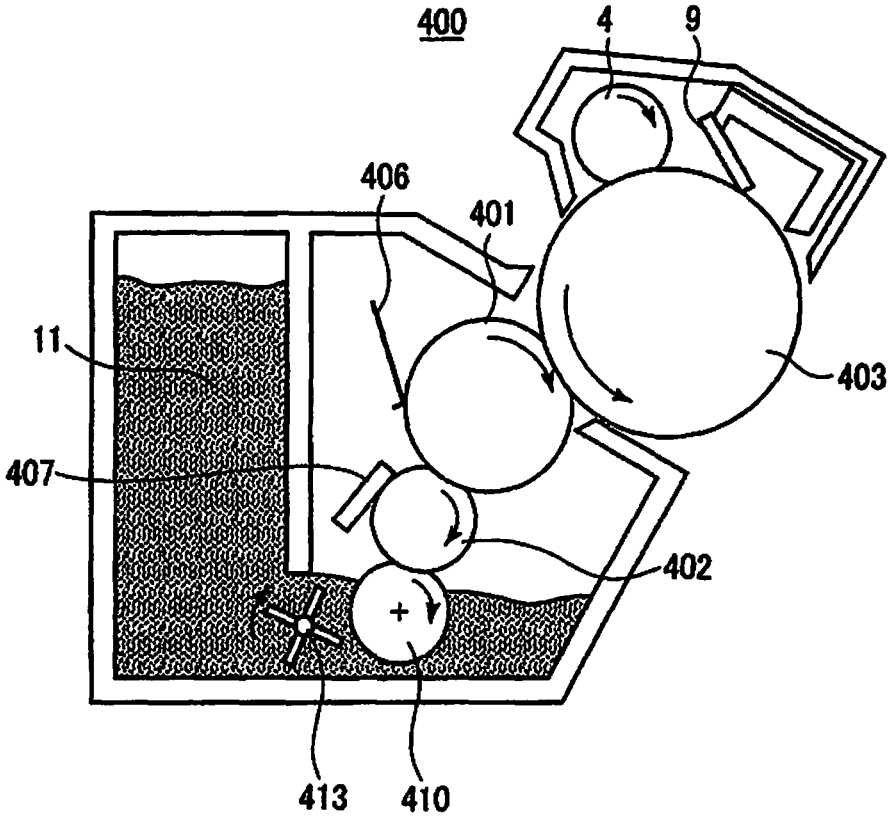
FIG. 16 is a diagram illustrating a development device of a comparative example to the first embodiment.

In order to compare with development device 100 of the embodiment, development device 400 of a comparative example shown in FIG. 16 is used.

Development device 400 of the comparative example shown in FIG. 16 is different from development device 100 of the embodiment in the following three points. (1) Development roller 401 and toner supply roller 402 are in contact with each other. (2) Toner supply roller 402 and charge blade 407 as a charge assistant member are in contact with each other. (3) Development roller 401, toner supply roller 402, and auxiliary supply roller 410 rotate in the same direction and move in the opposite direction to one another on each contact surface.

In other words, the above point (3) means auxiliary supply roller 410, toner supply roller 402, toner supply roller 2, and charge blade 407, as well as toner supply roller 402 and development roller 401 generate frictional force against toner 11 on each contact surface.

Figure 17:
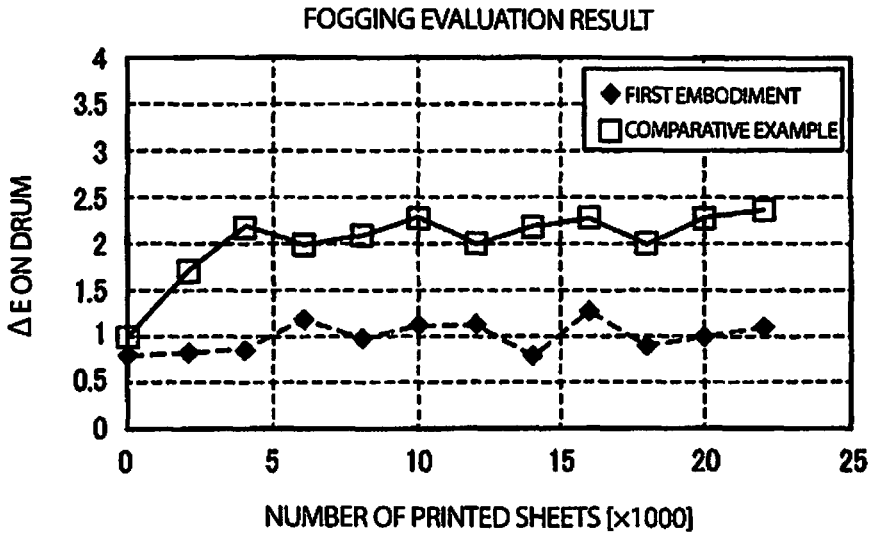
FIG. 17 is a figure showing the evaluation result of fogging when the development devices of the first embodiment and the comparative example are each mounted in the image formation apparatus to carry out a continuous printing operation.

FIG. 17 is a figure showing the evaluation result of fogging when development device 100 according to the embodiment and development device 400 of the comparative example are each mounted in image formation apparatus 300 and a continuous printing operation is carried out up to 22,000 sheets (life of a general image formation apparatus).

In this case, printing operation is stopped every printing of 2,000 sheets during a continuous printing and the above-mentioned fogging is evaluated.

Figure 18:
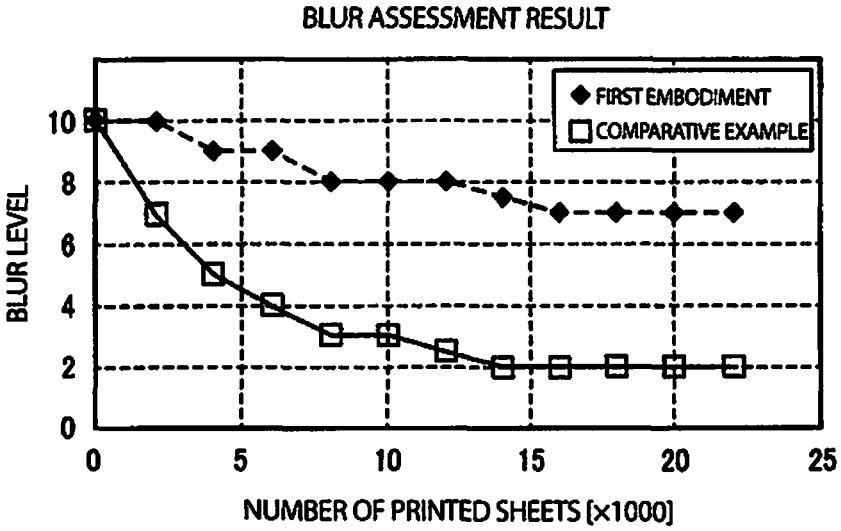
FIG. 18 is a figure showing the evaluation result of blur when the development devices of the first embodiment and the comparative example are each mounted in the image formation apparatus to carry out a continuous printing operation.

FIG. 18 is a figure showing the evaluation result of blur when development device 100 according to the embodiment and development device 400 of the comparative example are each mounted in image formation apparatus 300 and a continuous printing operation is carried out for up to 22,000 sheets.

In this case, the printing operation is stopped every printing of 2,000 sheets during a continuous printing and the above-mentioned solid pattern is printed to evaluate blur.

The results of FIGS. 17 and 18 show that fogging and blur are suppressed in development device 100 according to the embodiment as compared with development device 400 of the comparative example. This shows that a decrease in charging performance and a decrease in supply capability of toner 11 due to toner damage are suppressed in development device 100 according to the embodiment.

The reason to obtain such results can be understood to be as follows. That is, in development device 400 of the comparative example, the toner is easily damaged since toner 11 is supplied to development roller 401 using friction and the toner is charged using friction. On the other hand, in development device 100 of the embodiment, the toner damage can be suppressed since toner 11 is supplied to development roller 1 by toner supply roller 2 disposed in non-contact with development roller 1, and toner 11 is charged not by triboelectric charging, but by charge transfer due to the electric current which flows from toner supply roller 2 to auxiliary supply roller 10, or ion irradiation by the non-contact charge assistant member (saw-tooth electrode 7).

As described above, according to the first embodiment of the invention, toner 11 is supplied to development roller 1 using toner supply roller 2 disposed in non-contact with development roller 1. Further, toner supply roller 2 and auxiliary supply roller 10 rotate so as to move in the same direction with each other on the opposed surface, whereby the toner damage (separation and burial of the external additive, etc.) due to friction can be suppressed. Accordingly, degradation of printing quality (fogging and blur, etc.) can be suppressed to improve printing quality.

Moreover, the toner is charged using charge transfer due to the electric current which flows from toner supply roller 2 to auxiliary supply roller 10, or ion irradiation by the non-contact charge assistant member (saw-tooth electrode 7), whereby the toner damage can be suppressed and printing quality can be further improved as compared with the case where the toner is charged by triboelectric charging.

In addition, toner supply roller 2 and auxiliary supply roller 10 rotate so as to move at substantially the same speed on the opposed surface, whereby the toner damage due to friction can be suppressed as compared with the case where both move at a different speed.

Further, toner level 11*a* in casing 101 of development device 100 is controlled to below opposed part B between development roller 1 and toner supply roller 2 and opposed part A between saw-tooth electrode 7 and toner supply roller 2. Therefore, toner 11 adhered to toner supply roller 2 can be efficiently charged by saw-tooth electrode 7, and toner 11 can be moved toward development roller 1 (without being inhibited by other toners).

Furthermore, toner level 11*a* in casing 101 is controlled to be equal to or higher than the rotation center of auxiliary supply roller 10, whereby auxiliary supply roller 10 can easily carry toner 11 in casing 101 and can supply a sufficient amount of toner 11 to development roller 1.

The positional relationship between toner supply roller 2 and its respective surrounding rollers provides the following operational effects.

That is, in the rotation direction of toner supply roller 2, opposed part B between toner supply roller 2 and development roller 1 is located upstream of opposed part C between toner supply roller 2 and toner collection brush roller 5, whereby opposed part A between toner supply roller 2 and saw-tooth electrode 7 can be disposed upstream of opposed part B. Accordingly, saw-tooth electrode 7 can be prevented from being influenced by toner 11 which is recovered by toner collection brush roller 5 and flicked by flicker 8 for a toner collection brush.

Moving direction a (in FIG. 2B) of toner supply roller 2 and auxiliary supply roller 3 at opposed part D is the direction from the toner collection brush roller 5 side (right side in the drawing) toward the toner storage unit 12 side (left side in the drawing). Therefore, toner 11 carried by auxiliary supply roller 10 and toner 11 recovered by toner collection brush roller 5 are mixed upstream of opposed part D and reach opposed part D. Accordingly, a new toner and a recovered toner can be mixed and utilized.

Further, toner replenishment opening 12*a* of toner storage unit 12 is disposed outside opposed part A between toner supply roller 2 and saw-tooth electrode 7, opposed part B to development roller 1, and opposed part D to auxiliary supply roller 10 in the horizontal direction. Therefore, toner 11 provided from toner storage unit 12 for replenishment does not directly reach respective opposed parts A, B, and D. That is, toner 11 is first carried by auxiliary supply roller 10, then carried by toner supply roller 2, and further charged by saw-tooth electrode 7, thereafter reaching development roller 1, so that toner 11 is certainly charged and conveyed in this order. Accordingly, unevenness in the charge of toner 11 can be prevented.

Further, generation of an oscillating electric field between toner supply roller 2 and development roller 1 allows toner 11 on the surface of toner supply roller 2 to easily move (travel) toward development roller 1.

In addition, when the AC voltage applied to auxiliary supply roller 10 and toner supply roller 2 has the same frequency, the same peak-to-peak voltage, and the same phase, oscillation of the electric field between toner supply roller 2 and auxiliary supply roller 10 is prevented so that toner 11 can be stably charged and moved.

Second Embodiment

Figure 19:
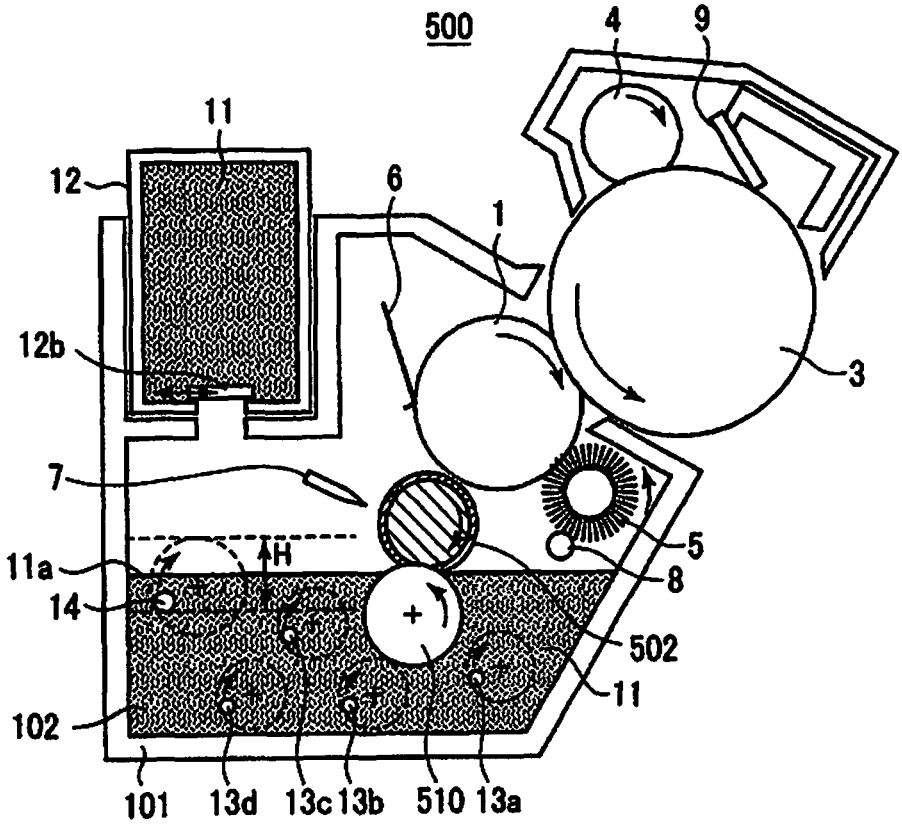
FIG. 19 is a cross-sectional view illustrating the configuration of a development device according to the second embodiment of the invention.
Figure 20:
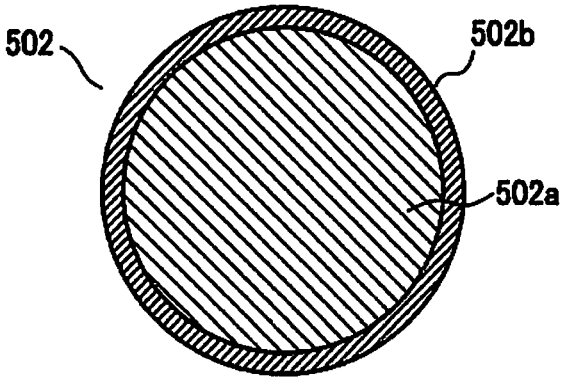
FIG. 20 is a diagram illustrating the cross-sectional structure of a toner supply roller of the development device according to the second embodiment.

FIG. 19 is a cross-sectional view illustrating development device 500 according to the second embodiment. Development device 500 of the second embodiment has a different configuration from development device 100 of the first embodiment in the following points. As shown in FIG. 20, toner supply roller 502 is used in which resin coat layer 502*b* is provided on the surface of cored bar 502*a* made of metal, and the resistance of auxiliary supply roller 510 is set lower than auxiliary supply roller 10 of the first embodiment.

As shown in FIG. 20, in toner supply roller (first supply member) 502 of the second embodiment, the surface of cored bar 502*a*, which is made of aluminum and has an outer diameter of 12.5 mm, is processed to have a surface roughness (ten-point average roughness) Rz of 1 μm less. Further, resin coat layer 502*b* with a thickness of 30 μm is provided on the surface of cored bar 502*a*. Resin coat layer 502*b* is made to have a surface roughness Rz of 1 μm or less. Thereby, the releasability of the toner (i.e., the ease of moving the toner to development roller 1) from the surface of toner supply roller 502 is secured.

Resin coat layer (surface layer) 502*b* includes thermoplastic polyether urethane resin as a base material and has semiconductivity imparted by adding carbon black thereto. Resin coat layer 502*b* desirably has a resistance in the range of $1\times10^6$ to $1\times10^9$ Ω at an applied voltage of 100 V according to the method for measurement described with reference to FIG. 10.

Auxiliary supply roller (second supply member) 510 desirably has a resistance in the range of $1\times10^6$ to $1\times10^9$ Ω at an applied voltage of 100 V according to the method for measurement described with reference to FIG. 10, and desirably has a resistance with the same number of digits as resin-coated toner supply roller 502. In this case, the resistance is set to $1\times10^8$ Ω.

The other configuration is the same as described in the first embodiment. Operation of development device 500 and the image formation apparatus is also the same as described in the first embodiment.

Next, a description is given of the print test with image formation apparatus 300 using development device 500 constituted as stated above.

Figure 21:
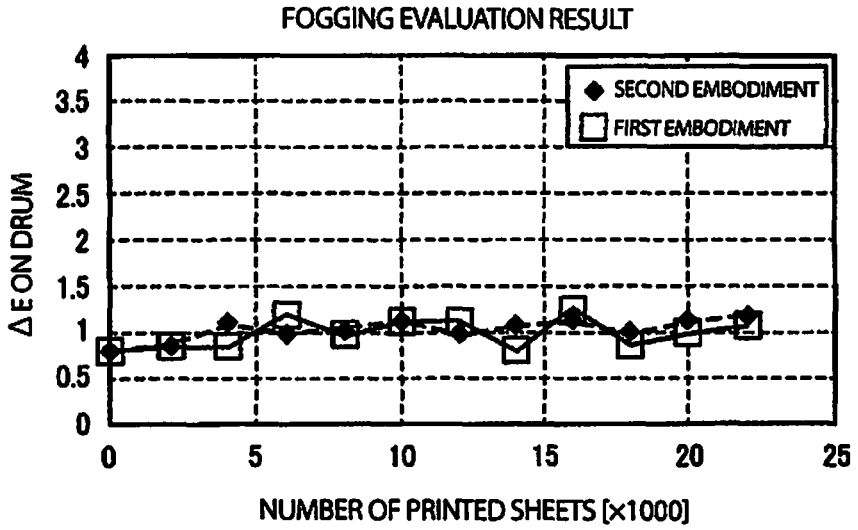
FIG. 21 is a figure showing the evaluation result of fogging when the development devices of the first embodiment and the second embodiment are each mounted in the image formation apparatus to carry out a continuous printing operation.
Figure 22:
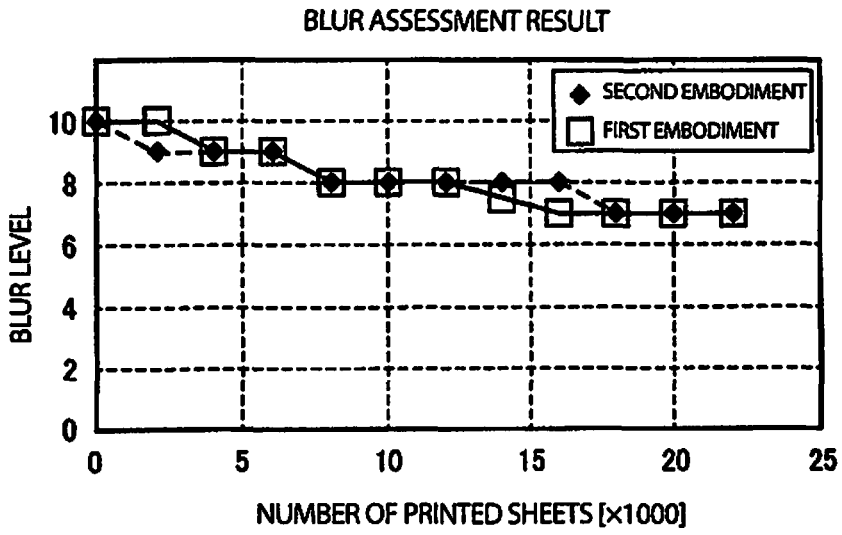
FIG. 22 is a figure showing the evaluation result of blur when the development devices of the first embodiment and the second embodiment are mounted in the image formation apparatus to carry out a continuous printing operation.

FIGS. 21 and 22 are figures showing the evaluation results of fogging and blur when development device 500 of the second embodiment and development device 100 of the first embodiment are each mounted in the image formation apparatus and continuous printing operation is carried out of up to 22,000 sheets.

The evaluation results of fogging and blur are as described in the first embodiment.

The results of FIGS. 21 and 22 show that almost the same effect as using development device 100 of the first embodiment is also obtained when development device 500 of the second embodiment is used.

Figure 23:
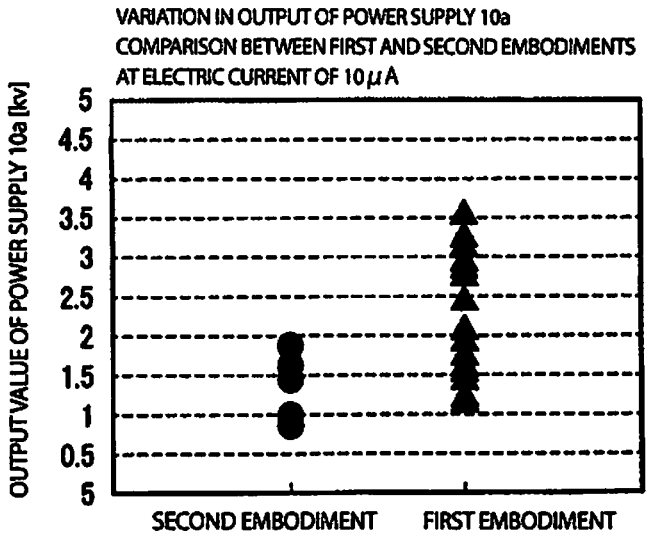
FIG. 23 is a figure showing the measured result of the variation in output voltage of an auxiliary supply roller power supply when an electric current flows from the toner supply roller toward the auxiliary supply roller in the development devices of the first and second embodiments.

FIG. 23 is a figure showing the measured result of the variation in bias voltage outputted by auxiliary supply roller power supply 10*a* when an electric current of 10 μA flows from toner supply roller 2 (502) toward auxiliary supply roller 10 (510) in development device 100 (500) of the first and second embodiments.

FIG. 23 shows that the variation in output voltage of auxiliary supply roller power supply 10*a* is smaller in the second embodiment with a small difference of the resistance between toner supply roller 502 and auxiliary supply roller 510 as compared with the first embodiment.

Figure 24A:
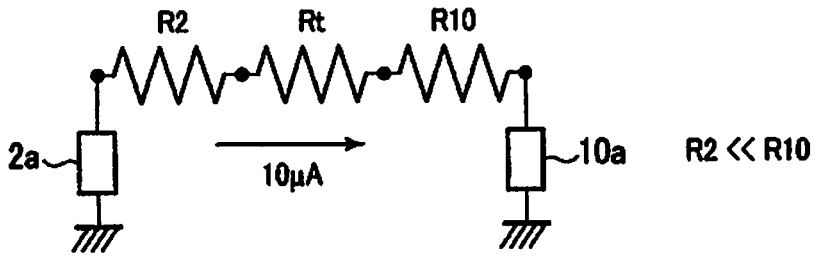
FIG. 24A is a schematic diagram of the first embodiment and FIG. 24B is a schematic diagram of the second embodiment, in which the toner supply roller, the auxiliary supply roller, and the toner therebetween are each expressed as electric resistance.

FIG. 24A is a schematic diagram in which toner supply roller 2, auxiliary supply roller 10, and the toner between toner supply roller 2 and auxiliary supply roller 10 according to the first embodiment are each expressed as electric resistance. Similarly, FIG. 29B is a schematic diagram in which toner supply roller 502, auxiliary supply roller 510, and the toner between toner supply roller 502 and auxiliary supply roller 510 according to the second embodiment are each expressed as electric resistance.

In FIG. 24A, combined resistance R of resistance R2 of toner supply roller 2, resistance R10 of auxiliary supply roller 10, and resistance Rt of the toner between toner supply roller 2 and auxiliary supply roller 10 is expressed as (R2+Rt+R10). Similarly, in FIG. 24B, combined resistance R of resistance 8502 of toner supply roller 502, resistance 8510 of auxiliary supply roller 510, and resistance Rt of the toner between toner supply roller 502 and auxiliary supply roller 510 is expressed as (R502+Rt+R510).

Figure 24B:
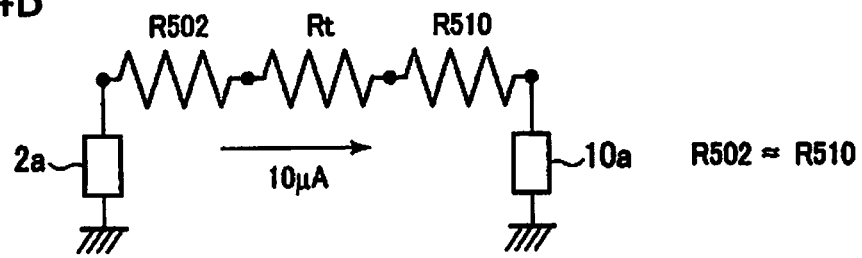

In this case, when Rt is neglected in consideration of the toner being a thin layer, the combined resistances in FIGS. 24A and 24B satisfy R=(R2+R10) and R=(R502+R510), respectively.

By the way, the resistance of auxiliary supply roller 10 (510) may be fluctuated by a change of the printing environment, a change of the toner filling rate in the cells of auxiliary supply roller 10 (510), and others.

Thus, when the resistance of auxiliary supply roller 10 (510) is fluctuated, as in the second embodiment, a smaller difference of the resistance between toner supply roller 502 and auxiliary supply roller 510 results in a smaller change of the combined resistance R, thereby leading to a smaller variation in the output voltage of auxiliary supply roller power supply 10*a* which is required to flow the desired electric current. That is, the cost of electric power can be reduced according to the second embodiment as compared with the first embodiment.

As described above, in addition to the same effect as the first embodiment, the effect to reduce the cost of electric power cost is further obtained according to the second embodiment.

Although a monochrome printer as an image formation apparatus comprising single development device 100 is described in the first and the second embodiments stated above, the invention is also applicable to a color image formation apparatus comprising development devices. In addition, the invention is applicable not only to a printer but also to a copy machine, a facsimile machine, and a MFT (Multi-Function Peripheral).

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A development device, comprising:

a developer carrier configured to develop an electrostatic latent image by.causing a developer to adhere to an electrostatic latent image carrier;

a first supply member disposed in non-contact with the developer carrier and configured to supply a developer to the developer carrier;

a second supply member disposed in contact with the first supply member below the first supply member and configured to supply the developer to the first supply member; and a developer holder configured to hold the developer for replenishing the second supply member, wherein the first supply member and the second supply member rotate so that surfaces thereof move in the same direction at their opposed parts.

2. The development device according to claim 1, further comprising a detector configured to detect an upper surface level of the developer in the developer holder.

3. The development device according to claim 1, further comprising a developer accommodation unit configured to replenish the developer holder with the developer.

4. The development device according to claim 1, wherein an electric current flows from the first supply member toward the second supply member.

5. The development device according to claim 1, further comprising a charge assistant member disposed opposed to the first supply member and configured to assist in charging the developer carried by the first supply member.

6. The development device according to claim 5, wherein the charge assistant member is provided in non-contact with the first supply member.

7. The development device according to claim 5, wherein the charge assistant member is provided in contact with the first supply member.

8. The development device according to claim 5, further comprising a developer accommodation unit configured to replenish the developer holder with the developer, wherein a position where the developer holder is replenished with the developer from the developer accommodation unit is located outside an opposed part between the first supply member and the charge assistant member, an opposed part between the first supply member and the developer carrier, and an opposed part between the first supply member and the second supply member in a horizontal direction.

9. The development device according to claim 1, wherein the first supply member and the second supply member rotate so that surfaces thereof move at substantially the same speed at their opposed parts.

10. The development device according to claim 1, wherein the first supply member has a surface roughness (Rz) of 1 μm or less.

11. The development device according to claim 1, wherein the first supply member comprises a resin layer on the surface of the first supply member, and the first supply member and the second supply member have a resistance with a same number of digits in a unit of ohms.

12. The development device according to claim 1, wherein the second supply member is a sponge-like rubber roller.

13. The development device according to claim 1, wherein an oscillating electric field is generated between the first supply member and the developer carrier.

14. The development device according to claim 1, further comprising a developer collection member disposed opposed to the developer carrier and configure to collect the developer on the developer carrier.

15. The development device according to claim 14, wherein an opposed part between the first supply member and the developer carrier is located upstream of an opposed part between the first supply member and the developer collection member in a rotation direction of the first supply member.

16. The development device according to claim 14, further comprising a developer accommodation unit configured to replenish the developer holder with the developer, wherein a moving direction of both the first supply member and the second supply member at their opposed parts is a direction from a developer collection member side toward a developer accommodation unit side.

17. An image formation apparatus including the development device of claim 1, wherein the development device further comprises:

a casing forming the developer holder;

a developer accommodation unit configured to replenish the casing with the developer; and a detector configured to detect an upper surface level of the developer provided in the casing for replenishment.

18. The image formation apparatus according to claim 17, further comprising a control unit configured to control the upper surface level of the developer provided in the casing for replenishment so that the upper surface level of the developer is lower than an opposed part between the first supply member and the developer carrier and an opposed part between the charge assistant member and the first supply member, based on detection information of the detector.

* * * * *